US006333143B1

(12) United States Patent
Shibata et al.

(10) Patent No.: US 6,333,143 B1
(45) Date of Patent: Dec. 25, 2001

(54) IMAGE-FORMING METHOD

(75) Inventors: Takeshi Shibata; Yuji Mihara, both of Minami-ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/372,612

(22) Filed: Aug. 12, 1999

(30) Foreign Application Priority Data

Aug. 26, 1998 (JP) ..... 10-254672

(51) Int. Cl.[7] ..... G03C 5/16

(52) U.S. Cl. ..... 430/350; 430/351; 430/203; 430/503; 430/572; 430/944

(58) Field of Search ..... 430/505, 572, 430/203, 350, 503, 559, 351, 391, 944

(56) References Cited

U.S. PATENT DOCUMENTS 4,824,759 * 4/1989 Sato et al. ..... 430/203
6,037,964 * 3/2000 Gomi et al. ..... 347/238

FOREIGN PATENT DOCUMENTS 2567653 10/1996 (JP) .

* cited by examiner

*Primary Examiner*—Thorl Chea
(74) *Attorney, Agent, or Firm*—Burns, Doane, Swecker & Mathis, LLP

(57) ABSTRACT

There is disclosed a method for forming an image on a light-sensitive material having on a base at least a light-sensitive silver halide emulsion and a binder, which comprises, subjecting at least one light-sensitive layer to exposure to light, by using an exposure head that has a plurality of different light sources for emitting lights in respective specific wavelength regions correspondingly to adjacent exposure picture elements, to form an image, wherein, in the specific wavelength regions from the shortest wavelength to the longest wavelength for the respective plurality of light sources to be used, the change in sensitivity of the light-sensitive material in the spectral sensitivity curve obtained by plotting the sensitivities of the light-sensitive material in terms of the specific wavelength regions including the wavelengths in centers of gravity of respective light sources is 0.01 log E/nm or less. According to the method, the unevenness of exposure density resulting from a plurality of exposure light sources can be improved.

8 Claims, No Drawings

IMAGE-FORMING METHOD

FIELD OF THE INVENTION

The present invention relates to a method for forming an image, and more particularly to a method for forming an image by exposing a heat-development light-sensitive material to light using at least one exposure head having a plurality of exposure light sources.

BACKGROUND OF THE INVENTION

Heat-development light-sensitive material is known in the art, and heat-development light-sensitive materials and their processes are described, for example, in "Shashin Kogaku no Kiso (Higinen Shashin-hen)" (published by Korona-sha, 1982), pages 242 to 255, and in U.S. Pat. No. 4,500,626.

Further, methods wherein, for example, dye images are formed by the coupling reaction of the oxidized product of a developing agent with a coupler are described, for example, in U.S. Pat. No. 3,761,270 and U.S. Pat. No. 4,021,240. Furthermore, methods for forming positive color images by the light-sensitive silver dye bleach process are described, for example, in U.S. Pat. No. 4,235,957.

Further, recently, the method wherein a diffusion dye is released or formed imagewise by heat development and the resultant diffusion dye is transferred to a dye-fixing element is proposed. In this method, by changing the type of the dye-providing compound to be used or the type of the silver halide to be used, a negative dye image, as well as a positive dye image, can be obtained. More details are described, for example, in U.S. Pat. No. 4,500,626, U.S. Pat. No. 4,483,914, U.S. Pat. No. 4,503,137, U.S. Pat. No. 4,559,290, JP-A-58-149049 ("JP-A" means unexamined published Japanese patent application), JP-A-60-133449, JP-A-59-218443, JP-A-61-238056, EP-A-220 746 (A2), the Journal of Technical Disclosure ("Kokai Giho") 87-6199, EP-A-210 660 (A2), and the like.

With respect to the method for obtaining a positive color image by heat development, various methods have been proposed. For example, U.S. Pat. No. 4,559,290 proposes a method wherein a so-called DRR compound, which has been formed into an oxidized compound incapable of releasing a dye image, is used under the coexistence with a reducing agent or a precursor thereof. In this method, the reducing agent is oxidized in proportion to the exposure amount of a silver halide by heat development, and the above oxidized compound is reduced with the unoxidized remaining reducing agent, to cause a diffusion dye to be released, to form a positive color image. Further, EP-A-220 746 (A) and the Journal of Technical Disclosure ("Kokai Giho") No. 87-6199 (Vol. 12, No. 22) describe heat-development color light-sensitive materials wherein use is made, as a compound capable of releasing a diffusion dye by the same mechanism, of a compound capable of releasing a diffusion dye by reductive cleavage of the N-X bond, in which X represents an oxygen atom, a nitrogen atom, or a sulfur atom.

Since the heat-development color light-sensitive material can be processed easily and rapidly in comparison with the conventional wet-development light-sensitive material, development can be conducted by means of a small-sized compact apparatus. Accordingly, relatively inexpensive apparatuses as color printers, or color copies of a silver salt color light-sensitive material system, are being developed and sold. To further broaden the application of these apparatuses, it is considered that various improvements are required.

As the exposure light source for these light-sensitive materials, various proposals are made, and as a digital exposure light source, for example, light-emitting diodes (LED), semiconductor lasers (LD), and various fluorescent substances are used. In the case of inexpensive LEDs or the like, scanning exposure is made by using an exposure head having a plurality of arranged elements, for example, to shorten the exposure time. However, in the system wherein exposure is made by using a plurality of elements like this for one light-sensitive layer, there is a problem that uneven density occurs on the image, due to dispersion (scattering) of the amount of light and exposure wavelength among the elements.

SUMMARY OF THE INVENTION

An object of the present invention is to provide an image-forming method that is improved with respect to the unevenness of exposure density resulting from a plurality of exposure light sources.

Other and further objects, features, and advantages of the invention will appear more fully from the following description.

DETAILED DESCRIPTION OF THE INVENTION

The above object of the present invention has been attained by:

(1) A method for forming an image on a light-sensitive material having on a base at least a light-sensitive silver halide emulsion and a binder, which comprises, subjecting at least one light-sensitive layer to exposure to light, by using an exposure head that has a plurality of different light sources for emitting lights in respective specific wavelength regions correspondingly to adjacent exposure picture elements, to form an image, wherein, in the specific wavelength regions from the shortest wavelength to the longest wavelength for the respective plurality of light sources to be used, the change in sensitivity of the light-sensitive material in the spectral sensitivity curve obtained by plotting the sensitivities of the light-sensitive material in terms of the specific wavelength regions including the wavelengths in centers of gravity of respective light sources is 0.01 log E/nm or less;

(2) The method for forming an image as stated in the above (1), wherein the light-sensitive material is a heat-development light-sensitive material having on a base at least three silver halide emulsions different in color sensitivity, a binder, and a dye-providing compound;

(3) The method for forming an image as stated in the above (1) or (2), wherein the exposure light sources for emitting lights in specific wavelength regions are LEDs having wavelengths selected in the light emitting wavelength range of the visible region and the infrared region; and (4) The method for forming an image as stated in the above (1) or (2), wherein the exposure light sources for emitting lights in specific wavelength regions are blue LEDs, green LEDs, and/or red LEDs.

That is, in the present invention, the wavelength dependence of the sensitivity (relative sensitivity) of the light-sensitive material is to be 0.01 log E/nm or less in the above specific wavelength regions.

When a plurality of light sources is used, a change (fluctuation) in density occurs because the light emitting wavelength and the amount of light of each of the light sources disperse. Therefore, the amount of light and the wavelength were measured separately and it was attempted to previously take measures for the correction to make them uniform. However, to the contrary to the expectation, the improvement in the unevenness of density was not satisfactory. It was found that this was because the correction became not satisfactory, due to a measurement error of wavelength in the spectral sensitivity region where the change in sensitivity for wavelength was drastic.

It is possible to select light sources of identical wavelengths by choosing previously, but the yield is considerably bad, which is unpreferable in view of the cost.

In the present invention, it has been found that this problem can be solved by designing a flat spectral sensitivity less varying in sensitivity for wavelength, in the range of light emitting wavelength regions used to correspond to respective color sensitivity regions. That is, it is required that the gradient of the sensitivity (in log E unit) for wavelength in the visible range of the density unevenness is 0.01 log E/nm or less.

In the exposure system for use in the present invention, for example, a method wherein image information is subjected to scanning exposure by causing light emitting diodes, various lasers (laser diodes, gas lasers, and the like), and the like to emit light through electrical signals can be used (including methods described, for example, in JP-A-2-129625, JP-A-5-176144, JP-A-5-199372, and JP-A-6-127021).

As the image information, use can be made of image signals obtained from video cameras, electronic still cameras, and the like; television signals including those represented by Nippon Television Signal Standard (NTSC), image signals obtained by dividing an original picture by a scanner or the like into a number of picture elements, and image signals made by using computers represented by CG and CAD.

The exposure light sources for use in the present invention are particularly effective when LEDs whose light source cost is cheap are used. An LED having a light emitting wavelength from the visible region to the infrared region can be used. In the case of a full-color light-sensitive material, three types of LEDs having light emitting wavelength regions corresponding to at least three spectral sensitivities different in color sensitivity, are used. The light emitting wavelength region ranges from the visible region to the infrared region, and it is not particularly restricted. To deal with the spectral sensitivity of usual color paper, a blue LED, a green LED, and a red LED are used.

The range from the shortest wavelength to the longest wavelength in the present invention (i.e., the specific wavelength region) is the range generally within ±10 nm, and particularly preferably within ±5 nm, selected from among 430 to 480 nm in the case of a blue LED; the range generally within ±10 nm, and particularly preferably within ±5 nm, selected from among 500 to 560 nm in the case of a green LED; and the range generally within ±10 nm, and particularly preferably within ±5 nm, selected from among 640 to 690 nm in the case of a red LED.

These wavelengths are defined as the wavelengths in centers of gravity of monochromatic lights of light sources.

In the present invention, a plurality of light sources is used and, for each light emitting color, in an exposure apparatus of size A4, use is made of preferably 2 to 400 light sources, and particularly preferably 5 to 100 light sources. Each light source can be used after measuring the amount of light and the wavelength and correcting those.

In the light-sensitive material used in the present invention, the spectral sensitivity is made broad, the peak wavelength is matched with the center of the above specific wavelength region, and the wavelength dependence is made 0.01 log/E/nm or less. Hereinbelow, this light-sensitive material is described in detail.

The light-sensitive material used in the present invention has on a base basically a light-sensitive silver halide, a binder, and a dye-providing compound (that can be played by a reducing agent in some cases as described later), and, if required, an organometallic salt oxidizing agent or the like can be contained.

These components are added to the same layer in many cases, but they may be added to separate layers if they are in a reactive state. For instance, when a colored dye-providing compound is allowed to present in a layer under a silver halide emulsion, the sensitivity can be prevented from lowering. A reducing agent is preferably built in the light-sensitive material, but it may be supplied from the outside, for example, by a method wherein it is diffused from a dye-fixing element as described later.

In order to obtain colors ranging widely on the chromaticity diagram by using three primary colors: yellow, magenta, and cyan, use is made of a combination of at least three silver halide emulsion layers photosensitive to respectively different spectral regions. In the present invention, it is preferable to use a combination of three layers of a blue-sensitive layer, a green-sensitive layer, and a red-sensitive layer. The photosensitive layers can be arranged in various orders known generally for color photographic materials. Further, each of these photosensitive layers can be divided into two or more layers if necessary.

Particularly, generally use is made of a method wherein a silver halide emulsion having a spectral sensitivity in the range of a wavelength of 400 to 500 nm (blue-sensitive emulsion) is contained in a light-sensitive layer containing a yellow-dye-providing compound, a silver halide emulsion spectrally sensitized in the range of a wavelength of 500 to 600 nm (green-sensitive emulsion) is contained in a light-sensitive layer containing a magenta-dye-providing compound, and similarly a silver halide emulsion spectrally sensitized in the range of a wavelength of 600 to 740 nm (red-sensitive emulsion) is contained in a light-sensitive layer containing a cyan-dye-providing compound. Further, in this case, since the yellow light-sensitive layer is colored yellow, it is desirably the uppermost light-sensitive layer away from the base.

That is, preferably, the application (coating) is made in order, from the base, of the red-sensitive layer that contains a cyan-dye-providing compound, the intermediate layer, the green-sensitive layer that contains a magenta-dye-providing compound, the intermediate layer, the blue-sensitive layer that contains a yellow-dye-providing layer, the intermediate layer, and the protective layer.

If the cyan layer and the magenta layer are reversed, the properties are approximately the same. Each light-sensitive layer may consist of two layers, and each of the two layers may contain a dye-providing compound and a silver halide emulsion, or it is also possible that only the upper layer contains a silver halide emulsion and the lower layer contains a dye-providing compound, to make it high in sensitivity.

The heat-development color light-sensitive material may be provided with a variety of auxiliary layers, such as a protective layer, an undercoat layer, an intermediate layer, a yellow filter layer, an untihalation layer, and a backing layer.

If the base is a polyethylene laminated paper containing a white pigment, such as titanium oxide, it is required that the backing layer be designed to have an antistatic function and a surface resistivity of $10^{12}$ Ω·cm or less.

Hereinbelow, the silver halide emulsion that can be used in the heat-development color light-sensitive material for use in the present invention is described in detail.

The silver halide emulsion generally contains gold in an amount of $1.0\times10^{-7}$ mol to $1.0\times10^{-5}$ mol, and preferably $3.0\times10^{-7}$ mol to $3.0\times10^{-6}$ mol, per mol of silver.

Such a content of gold is the amount to be contained finally in the silver halide emulsion, and that gold is added mainly when the silver halide emulsion is prepared, specifically when it is subjected to chemical sensitization, but the present invention is not limited by the time when gold is added.

As is described layer, the time of the addition may be at any stage of chemical sensitization, or the addition may be made after the process of the chemical sensitization but before the application. Also the addition may be made before the removal of excess salts after the formation of grains.

Further, the gold for the gold sensitization may be added in portions separately so that the amount of gold may fall in the above range. That addition may be carried out continuously or discontinuously. In the chemical sensitization, gold may be added in an amount smaller than the above prescribed amount and the deficiency is supplied at a time from after the completion of the chemical sensitization to immediately before the application. The inventors of the present invention have found that the heat fogging in the heat-development light-sensitive material, to which a gold/sulfur-sensitized silver halide emulsion is applied, depends mainly on the amount of gold used in the chemical sensitization, and thus the content of gold in the silver halide emulsion is to be in the above range on the basis of this finding. Hence, if the content of gold is outside the above range, that is, if the amount of gold is too large, heat fogging is apt to occur, while if the amount of gold is too small, the clear effect of the gold sensitization is hard to obtain.

In the silver halide emulsion layer, the gold sensitizer is present mainly on the silver halide grain surface, but part thereof may be present in the gelatin, the binder.

For the gold sensitization in the present invention, the oxidation number of the gold in the gold sensitizer may be a valence of +1 or +3, and specifically, for example, a chloroaurate, potassium chloroaurate, auric trichloride, potassium auricthiocynate, potassium iodoaurate, and tetracyanoauric acid can be used.

The chemical sensitization can be carried out by such gold sensitization only, or by such gold sensitization in combination with sulfur or selenium sensitization, with the latter preferred. Further, other chemical sensitization, such as reduction sensitization, can be additionally used.

With respect to the conditions, such as the temperature, the pH, and the pAg, under which the chemical sensitization is carried out, the temperature is generally 40 to 90° C. and preferably 45 to 75° C., the pH is generally 3 to 9 and preferably 4 to 8, and the pAg is generally 5 to 11 and preferably 7 to 10.

In the present invention, as described above, gold sensitization and sulfur sensitization can be used in combination. The sulfur sensitizer for the sulfur sensitization includes active gelatin and a sulfur-containing compound reactive with silver, and, for example, thiosulfates, ally thiocarbamide, thiourea, ally isothiocyanates, cystine, p-toluene thiosulfonates, thiocyanogen (rhodan), and mercapto compounds are used.

Further, those described, for example, in U.S. Pat. No. 1,574,944, U.S. Pat. No. 2,410,689, U.S. Pat. No. 2,278,947, U.S. Pat. No. 2,728,668, and U.S. Pat. No. 3,656,955 can also be used.

The sulfur sensitizer can be used in an amount ranging from $10^{-7}$ to $10^{-2}$ per mol of silver.

In the present invention, selenium sensitization can be used as described above. As the selenium sensitizer, for example, aliphatic isoselenocyanates, such as ally isoselenocyanate; selenoureas, selenoketons, selenoamides, selenocarboxylic acids, selenoesters, selenophosphates, and selenides, such as diethyl selenide and diethyl diselenide, can be used, and their specific examples are described in U.S. Pat. No. 1,574,944, U.S. Pat. No. 1,602,592, and U.S. Pat. No. 1,623,499.

The selenium sensitizer can be used in an amount ranging from $10^{-7}$ to $10^{-2}$ per mol of silver.

Other chemical sensitization method that can be additionally used in the present invention includes the reduction sensitization method wherein a reducing substance (e.g., stannous salts, amines, hydrazine derivatives, formamidine-sulfinic acids, and silane compounds) is used, and the noble metal sensitization method wherein a noble metal compound (e.g., a complex salt of a metal of Group 8 of the periodic table, such as Pt, It, and Pd) is used.

The reduction sensitization method is described, for example, in U.S. Pat. No. 2,983,609, U.S. Pat. No. 2,419,974, and U.S. Pat. No. 4,054,458, and the noble metal sensitization method is described, for example, in U.S. Pat. No. 2,399,083, U.S. Pat. No. 2,448,060, and Great Britain Patent No. 618 061.

The addition of the gold sensitizer in the case wherein gold sensitization is used in combination with sulfur sensitization or selenium sensitization may be carried out at the same time as that of the sulfur sensitizer or the selenium sensitizer, or during the sulfur sensitization or selenium sensitization or after the completion thereof.

The same is applied if other chemical sensitization is additionally used.

In the present invention, these chemical sensitizers including the gold sensitizer are added to the silver halide photographic emulsion in the usual manner. That is, in the case of compounds soluble in water, they are added in the form of an aqueous solution, and in the case of compounds soluble in an organic solvent, they are added in the form of a solution of an organic solvent readily mixable with water, such as methanol and ethanol.

The chemical sensitization can be carried out in the presence of a nitrogen-containing heterocyclic compound (Great Britain Patent No. 1 315 755, JP-A-50-63914, JP-A-51-77223, JP-A-58-126526, and JP-A-58-215644).

It is also useful to carry out the chemical sensitization in the presence of an acetylene compound, as described in JP-B-39-22067 ("JP-B" means examined Japanese patent publication) and JP-B-39-22068, in order to obtain a silver halide emulsion low in fogging.

Further, it is also effective to carry out the chemical sensitization in the presence of a silver halide solvent. As the silver halide solvent used, thiocyanates and solvents described in JP-A-63-151618 can be used.

The silver halide emulsion that can be used in the present invention may be made of any of silver chloride, silver bromide, silver iodobromide, silver chlorobromide, silver chloroiodide, and silver chloroiodobromide.

The silver halide emulsion that is used in the present invention may be a surface-latent-image-type emulsion or an internal-latent-image-type emulsion. The internal-latent-image-type emulsion is used in combination with a nucleator or a light-fogging agent, to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or JP-A-4-223643. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by F. Glafkides in Chemie et Phisique Photographique, Paul Montel (1967); by G. F. Duffin in Photographic Emulsion Chemistry, Focal Press, 1966; and by V. L. Zelikman et al., in Making and Coating Photographic Emulsion, Focal Press, 1964.

Next, all of silver halide grains which are used in the heat-development color light-sensitive material for use in the present invention is described.

In the process for preparing the light-sensitive silver halide emulsion for use in the present invention, so-called desalting, for removing excess salts, is preferably carried out. As a means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

The light-sensitive silver halide emulsion that is used in the present invention may contain a heavy metal, such as iridium, rhodium, platinum, cadmium, zinc, thallium, lead, iron, and, osmium, for various purposes. The compounds of the heavy metal may be used singly or in the form of a combination of two or more. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, JP-A-1-116637, and JP-A-5-181246 are preferably used.

A preferable amount of iridium to be added, to the silver halide emulsion used in the present invention is $10^{-9}$ to $10^{-4}$ mol, and more preferably $10^{-8}$ to $10^{-6}$ mol, per mol of the silver halide. In the case of a core/shell emulsion, iridium may be added to the core and/or the shell. As the compound, $K_2IrCl_6$ or $K_3IrCl_6$ is preferably used.

Further, a preferable amount of rhodium to be added, to the silver halide emulsion used in the present invention is $10^{-9}$ to $10^{-6}$ mol, per mol of the silver halide.

Further, a preferable amount of iron to be added, to the silver halide emulsion used in the present invention is $10^{-7}$ to $10^{-3}$ mol, and more preferably $10^{-6}$ to $10^{-3}$ mol, per mol of the silver halide.

A method wherein a fine-grain emulsion of silver chloride, silver chlorobromide, silver bromide, silver iodobromide, or the like is doped previously with part or all of these heavy metals and the resulting fine-grain emulsion is added to dope the silver halide emulsion surface locally, is preferably used.

In the step for forming grains of the light-sensitive silver halide emulsion for use in the present invention, as a silver halide solvent, a rhodanate, ammonia, a tetrasubstituted thioether compound, an organic thioether derivative described in JP-B-47-11386, or a sulfur-containing compound described in JP-A-53-144319 can be used.

As other conditions employed to prepare the emulsion in the present invention, the description, for example, by F. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, the ammonia process, and the like can be used; and to react a soluble silver salt with a soluble halogen salt, any of the single-jet method, the double-jet method, a combination thereof, and the like can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the crystals, the concentrations, the amounts, and the speeds of the silver salt and the halide to be added may be increased (e.g. JP-A-55-142329 and JP-A-55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.2 to 8.5, and more preferably 2.5 to 7.5.

The coating amount of the light-sensitive silver halide emulsion used in the present invention is generally in the range of 1 mg to 10 g/m$^2$ in terms of silver.

When the photosensitive silver halide used in the present invention is made to have color sensitivities of blue sensitivity, green sensitivity, and red sensitivity, the photosensitive silver halide emulsion is spectrally sensitized with methine dyes or the like. If required, it may be spectrally sensitized in the infrared region. Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257, JP-A-59-180550, JP-A-64-13546, JP-A-5-45828, and JP-A-5-45834 can be mentioned. The sensitizing dyes is preferably a so-called M-band type sensitizing dye to achieve the purpose of the present invention.

These sensitizing dyes can be used singly or in combination, and a combination of these sensitizing dyes is preferable, particularly to adjust the wavelength of the spectral sensitivity and to carry out supersensitization. The number of the sensitizing dyes used in the combination is preferably more than 2 and less than 5.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. No. 4,183,756 and U.S. Pat. No. 4,225,666. Further, these sensitizing dyes and supersensitizers may be added in the form of a solution of an organic solvent, such as methanol, or in the form of a dispersion of gelatin or the like, or in the form of a solution of a surface-active agent. Generally the amount of the sensitizing dye to be added is of the order of $10^{-8}$ to $10^{-2}$ mol per mol of the silver halide.

These additives used in the above process, and coventionally known additives for photography that can be used in the heat-development light-sensitive materials and dye-fixing materials which is used in the present invention, are described in Research Disclosure No. 17643; Research Disclosure No. 18176; and Research Disclosure No. 307105, whose particular parts are given below in a table.

| | Additive | RD 17643 | RD 18716 | RD 307105 |
|---|---|---|---|---|
| 1 | Chemical sensitizers | p. 23 | p. 648 (right column) | p. 866 |
| 2 | Sensitivity-enhancing agents | — | p. 648 (right column) | — |
| 3 | Spectral sensitizers and Supersensitizers | pp. 23–24 | pp. 648 (right column)–649 (right column) | pp. 866–868 |
| 4 | Brightening agents | p. 24 | pp. 648 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Image dye stabilizers | p. 25 | p. 650 (left column) | p. 872 |
| 8 | Hardeners | p. 26 | p. 651 (left column) | pp. 874–875 |
| 9 | Binders | p. 26 | p. 651 (left column) | pp. 873–874 |
| 10 | Plasticizers and Lubricants | p. 27 | p. 650 (right column) | p. 876 |
| 11 | Coating aids and Surfactants | pp. 26–27 | p. 650 (right column) | pp. 875–876 |
| 12 | Antistatic agents | p. 27 | p. 650 (right column) | pp. 876–877 |
| 13 | Matting agents | — | — | pp. 878–879 |

As the binder of the constitutional layer of the heat-development light-sensitive material or the dye-fixing material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3M$ (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or so-called de-ashed gelatin, wherein the contents of calcium, etc., are reduced, can be selected to meet various purposes, and combinations of these gelatins are also preferably used.

If a system wherein the heat development is carried out with a slight amount of water supplied is adopted, the absorption of water can be rapidly carried out by using the above high-water-absorptive polymer. Further, when the high-water-absorptive polymer is used in the dye-fixing layer or its protective layer, after the transfer the dye can be prevented from transferring again from the dye-fixing element to another material.

In the present invention, the coating amount of the binder is preferably 20 g or less, more preferably 10 g or less, and further properly 0.5 to 7 g, per $m^2$.

In the present invention, the light-sensitive silver halide emulsion may be used together with an organic metal salt as an oxidizing agent. Among the organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the coating amount of the light-sensitive silver halide emulsion and organosilver salts is generally 0.05 to 10 g/$m^2$, and preferably 0.1 to 4 g/$m^2$, in terms of silver.

As the reducing agent that can be used in the present invention, those known in the field of heat-development light-sensitive material can be used. Further, the later-described dye-providing compounds having reducibility are also included (in this case, another reducing agent can be used additionally). Reducing agent precursors that have no reducibility themselves but exhibit reducibility by the action of heat or a nucleophilic agent during the process of development, can be used.

Examples of the reducing agent that can be used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and European Patent No. 220 746, pages 78 to 96.

Combinations of various reducing agents as disclosed in U.S. Pat. No. 3,039,869 can also be used.

When a non-diffusible reducing agent is used, an electron-transport agent and/or an electron-transport agent precursor can be used additionally, if necessary, in order to accelerate the electron transport between the non-diffusible reducing agent and the developable silver halide. Particularly preferably, those described, for example, in the above-mentioned U.S. Pat. No. 5,139,919, EP-A-418 743, JP-A-1-138556, and JP-A-3-102345 are used. Further, a method wherein it is introduced in a layer stably as described in JP-A-2-230143 and JP-A-2-235044 is preferably used.

The electron-transport agent or its precursor can be chosen from among the above reducing agents or their precursors. The electron-transport agent and its precursor are desirably greater in its movability than the non-diffusible reducing agent (electron provider). Particularly useful electron-transport agents are 1-phenyl-3-pyrazolidones and aminophenols.

As the non-diffusible reducing agent (electron provider) used in combination with the electron-transport agent, those that are among the above reducing agents and that are substantially not movable in the layers of the light-sensitive material are suitable. As examples of those, preferably, for example, hydroquinones, sulfonamidophenols, sulfonamidonaphtholes, compounds described as electron providers in JP-A-53-110827, U.S. Pat. No. 5,032,487, U.S. Pat. No. 5,026,634, and U.S. Pat. No. 4,839,272, and the below-described non-diffusible, dye-providing compounds having reducibility can be mentioned.

Electron provider precursors as described in JP-A-3-160443 are also preferably used.

Further, the above reducing agents can be used in intermediate layers and protective layers for various purposes, for example, of the color-mixing inhibition, the improvement of color reproduction, the improvement of the white background, and the prevention of silver from migrating to the dye-fixing material. Specifically, reducing agents described in EP-A-524 649, EP-A-357 040, JP-A-4-249245, JP-A-2-64633, JP-A-2-46450, and JP-A-63-186240 are preferably used. Reducing compounds that release a development inhibitor, as described in JP-B-3-63733, JP-A-1-150135, JP-A-2-110557, JP-A-2-64634, JP-A-3-43735, and EP-A-451 833, can also be used.

The total amount of the reducing agent to be added in the present invention is generally 0.01 to 20 mol, and particularly preferably 0.1 to 10 mol, per mol of silver.

To form a color image in the present invention, a compound that, when silver ions are reduced to silver under high temperature conditions, releases a diffusion dye correspondingly to this reaction, that is, a dye-providing compound can be used.

Examples of the dye-providing compound include compounds having a function of releasing a diffusion dye imagewise. The compounds of this type can be represented by the following formula [LI]:

$$((\text{Dye})m-Y)n-Z \qquad [LI]$$

Dye represents a dye group or a dye precursor group, or a dye group or a dye precursor group whose wavelength is temporarily shortened, Y represents a single bond or a linking group, Z represents a group which has such a property that produces a difference in the diffusibility of the compound represented by ((Dye)m−Y)n−Z correspondingly to the light-sensitive silver salt having a latent image imagewise, or that releases (Dye)m−Y, to produce a difference in the diffusibility between (Dye)m−Y released and ((Dye)m−Y)n−z, m is an integral number of 1 to 5, n is 1 or 2, and when m or n is not 1, a plurality of Dyes are the same or different. More specifically, the following compounds (1) and (2) are mentioned.

Compound (1) is a coupler (DDR coupler) having a diffusion dye, as a coupling split-off group, and it is a non-diffusion compound itself that can release a diffusion dye upon reaction with the oxidized product of a reducing agent. Specific examples include those described, for example, in Great Britain Patent No. 1 330 524, JP-B-48-39165, U.S. Pat. No. 3,443,940, U.S. Pat. No. 4,474,867, and U.S. Pat. No. 4,483,914.

Compound (2) is a non-diffusion compound itself (DRR compound) that can reduce silver halides or organosilver salts and can release a diffusible dye upon reducing them. Typical examples thereof include those described, for example, in U.S. Pat. No. 3,928,312, U.S. Pat. No. 4,053,312, U.S. Pat. No. 4,055,428, U.S. Pat. No. 4,336,322, JP-A-56-65839, JP-A-59-69839, JP-A-53-3819, JP-A-51-104343, RD No. 17,465, U.S. Pat. No. 3,725,062, U.S. Pat. No. 3,728,113, U.S. Pat. No. 3,443,939, JP-A-58-116537, JP-A-57-179840, and U.S. Pat. No. 4,500,626. As specific examples of the DRR compound, compounds described in the above U.S. Pat. No. 4,500,626, columns 22 to 44, can be mentioned, and in particular, compounds (1) to (3), (10) to (13), (16) to (19), (28) to (30), (33) to (35), (38) to (40), and (42) to (64) described in the above US patent are preferable. Compounds described in U.S. Pat. No. 4,639,408, columns 37 to 39, are also useful. In addition, as dye-providing compounds other than the above-described couplers and those represented by formula [LI], for example, dye silver compounds formed by combining an organosilver salt with a dye (in, for example, Research Disclosure, May, 1978, pages 54 to 58), azo dyes used in the heat-development silver dye bleach process (in, for example, U.S. Pat. No. 4,235,957 and Research Disclosure, April, 1976, pages 30 to 32), and leuco dyes (in, for example, U.S. Pat. No. 3,985,565 and U.S. Pat. No. 4,022,617) can be used.

In the present invention, particularly these DRR compounds are preferably used.

Hydrophobic additives used in the present invention, such as dye-providing (dye-donative) compounds and nondiffusion reducing agents, can be introduced into photographic constitutional layers of a heat-development photographic material by a known method, such as the one described in U.S. Pat. No. 2,322,027. In this case, use can be made of a high-boiling organic solvent as described, for example, in U.S. Pat. No. 4,555,470, U.S. Pat. No. 4,536,466, U.S. Pat. No. 4,536,467, U.S. Pat. No. 4,587,206, U.S. Pat. No. 4,555,476, U.S. Pat. No. 4,599,296, and JP-B-3-62256, if necessary, in combination with a low-boiling organic solvent having a boiling point of 50 to 160° C. These dye-providing compounds, nondiffusion reducing agents, high-boiling organic solvents, and the like can be used in the form of a combination of two or more.

The high-boiling organic solvent is used in an amount of generally 10 g or less, preferably 5 g or less, and more preferably 1 g to 0.1 g, per g of the dye-providing compound to be used. The amount is also generally 1 cc or less, preferably 0.5 cc or less, and more preferably 0.3 cc or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used are listed in JP-A-59-157636, pages (37) to (38), and in the Research Disclosure (RD) publication shown above.

In the heat-development light-sensitive material for use in the present invention, use can be made of a compound that can activate the development and can make the image stable. Preferable specific compounds for use are described in U.S. Pat. No. 4,500,626, the 51st column to the 52nd column.

In the system for forming an image by diffusion transfer of a dye, various compounds can be added to the constitutional layers of the heat-development light-sensitive material for use in the present invention, for the purpose of fixing unnecessary dyes or colored substances or rendering them colorless, to improve the white background of the resulting image.

Specifically, compounds described in EP-A-353 741, EP-A-461 416, JP-A-63-163345, and JP-A-62-203158 can be used.

For the constitutional layers of the heat-development light-sensitive material for use in the present invention, various pigments and dyes can be used for the purpose of improving color separation and making sensitivity high.

Specifically, compounds described in the above Research Disclosures, and compounds and layer structures described, for example, in EP-A-479 167, EP-A-502 508, JP-A-1-167838, JP-A-4-343355, JP-A-2-168252, JP-A-61-20943, EP-A-479 167, and EP-A-502 508 can be used.

In the system wherein an image is formed by diffusion transfer of a dye, a dye-fixing material is used together with the heat-development light-sensitive material. The dye-fixing material may be either in the form wherein the dye-fixing material is applied on a base different from that of the light-sensitive material, or in the form wherein the dye-fixing material is applied on the same base as that of the light-sensitive material. As for the mutual relationship of the light-sensitive material to the dye-fixing material, and the relationship thereof to the base, and to the white reflective layer, the relationship described in U.S. Pat. No. 4,500,626, column 57, can also be applied to the present invention.

The dye-fixing material preferably used in the present invention has at least one layer containing a mordant and a binder. As the mordant, one known in the field of photography can be used, and specific examples thereof include mordants described in U.S. Pat. No. 4,500 626, columns 58 to 59, JP-A-61-88256, pages (32) to (41), and JP-A-1-161236, pages (4) to (7), and those described, for example, in U.S. Pat. No. 4,774,162, U.S. Pat. No. 4,619,883, and U.S. Pat. No. 4,594,308. Further, dye-accepting polymer compounds as described in U.S. Pat. No. 4,463,079 may be used.

The binder used in the dye-fixing material for use in the present invention is preferably the above hydrophilic binder. Further, the additional use of carrageenans, as described in EP-A-443 529, and latexes having a glass transition temperature of 40° C. or less, as described in JP-B-3-74820, is preferable.

The dye-fixing material may be provided, if necessary, with an auxiliary layer, such as a protective layer, a release (split-off) layer, an undercoat layer, an intermediate layer, a backing layer, and a curling-preventive layer. Particularly, the provision of a protective layer is useful.

For the constitutional layers of the heat-development light-sensitive material and the dye-fixing material, use can be made of a plasticizer, a slip agent, or a high-boiling organic solvent as a releasability improver between the light-sensitive material and the dye-fixing material. Specifically, those described, for example, in the above Research Disclosures and JP-A-62-245253 can be mentioned.

Further, for the above purpose, a variety of silicone oils (all silicone oils including dimethylsilicone oils and modified silicone oils formed by introducing various organic groups into dimethylsiloxanes) can be used. For example, various modified silicone oils described in "Hensei Silicone Oils," Gijyutsu Shiryo, P6 to 18B, published by Shinetsu Silicone K.K., and particularly carboxy-modified silicone (trade name: X-22-3710) are effective.

Further, silicone oils described in JP-A-62-215953 and JP-A-63-46449 are also effective.

In the heat-development light-sensitive material and the dye-fixing material, an anti-fading (anti-discoloring) agent may be used. As the anti-fading agent, can be mentioned, for example, an antioxidant, an ultraviolet absorber, or a certain type of metal complex, and, for example, ultraviolet absorbers and dye-image stabilizers described in the above Research Disclosures are also useful.

As the antioxidant, there are, for example, chroman-series compounds, coumaran-series compounds, phenol-series compounds (e.g., hindered phenols), hydroquinone derivatives, hindered amine derivatives, and spiroindane-series compounds. Further, compounds described in JP-A-61-159644 are also effective.

As the ultraviolet absorber, there are benzotriazole-series compounds (U.S. Pat. No. 3,533,794 etc.), 4-thiazolidone-series compounds (U.S. Pat. No. 3,352,681 etc.), and benzophenone-series compounds (JP-A-46-2784 etc.), as well as compounds described, for example, in JP-A-54-48535, JP-A-62-136641, and JP-A-61-88256. Further, ultraviolet absorbable polymers described in JP-A-62-260152 are also effective.

As the metal complex, there are compounds described, for example, in U.S. Pat. No. 4,241,155, U.S. Pat. No. 4,245,018 in columns 3 to 36, U.S. Pat. No. 4,254,195 in columns 3 to 8, JP-A-62-174741, JP-A-61-88256 on pages (27) to (29), JP-A-63-199248, JP-A-1-75568, and JP-A-1-74272.

The anti-fading agent for preventing the dye transferred to the dye-fixing material from fading may be contained previously in the dye-fixing material, or it may be supplied to the dye-fixing material from the outside, for example, from the heat-development light-sensitive material or the later-described transfer solvent.

The above antioxidants, ultraviolet absorbers, and metal complexes may be used in combination each other.

In the heat-development light-sensitive material and the dye-fixing material, a fluorescent whitening agent may be used. Particularly preferably, the fluorescent whitening agent is built in the dye-fixing material or it is supplied from the outside, for example, from the heat-development light-sensitive material or the transfer solvent. As examples thereof, can be mentioned compounds described, for example, in "The Chemistry of Synthetic Dyes," Vol. V, Section 8, edited by K. Veenkataraman and in JP-A-61-143752. More specifically, for example, stilbene-series compounds, coumarin-series compounds, biphenyl-series compounds, benzoxazolyl-series compounds, naphthalimide-series compounds, pyrazoline-series compounds, and carbostyryl-series compounds can be mentioned.

The fluorescent whitening agent can be used in combination with the anti-fading agent or the ultraviolet absorber.

Specific examples of these anti-fading agent, ultraviolet absorber, and fluorescent whitening agent are described in JP-A-62-215272, pages (125) to (137), and JP-A-1-161236, pages (17) to (43).

Examples of the hardening agent that is used in constitutional layers of the heat-development light-sensitive material or the dye-fixing material, include hardening agents described, for example, in the above Research Disclosures, U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis (vinylsulfonylacetamido)ethane, etc.), an N-methylol-series hardening agent (dimethylol urea, etc.), or a polymer hardening agent (compounds described, for example, in JP-A-62-234157), can be mentioned.

These hardening agents are used in an amount of generally 0.001 to 1 g, and preferably 0.005 to 0.5 g, per g of the gelatin coated. The layer into which the hardeners are added may be any of layers that constitute the photographic material or the dye-fixed material, or the hardener may be divided into two or more parts, which are added into two or more layers.

In the constitutional layers of the heat-development photographic material or the dye-fixing material, various antifoggants or photographic stabilizers and their precursors can be used. Specific examples thereof include compounds described, for example, in the above-mentioned Research Disclosures, U.S. Pat. No. 5,089,378, U.S. Pat. No. 4,500,627, U.S. Pat. No. 4,614,702, JP-A-62-13546 (pages (7) to (9), (57) to (71), and (81) to (97)), U.S. Pat. No. 4,775,610, U.S. Pat. No. 4,626,500, and U.S. Pat. No. 4,983,494, JP-A-62-174747, JP-A-62-239148, JP-A-63-264747, JP-A-1-150135, JP-A-2-110557, JP-A-2-178650, and Research Disclosure No. 17,643 (1978), pages (24) to (25).

These compounds are preferably used in an amount of $5\times10^{-6}$ to $1\times10^{-1}$ mol, and more preferably $1\times10^{-5}$ to $1\times10^{-2}$ mol, per mol of silver.

In the constitutional layers of the heat-development photographic material or dye-fixing material, use can be made of various surface-active agents for various purposes of, for example, serving as a coating aid, improving releasability and slipping property, preventing electrification, or accelerating development. Specific examples of the surface-active agents are described, for example, in the above Research Disclosures and JP-A-62-173463 and JP-A-62-183457.

In the constitutional layers of the heat-development photographic material or dye-fixing material, an organofluoro compound may also be contained, for example, for the purposes of improving slipping properties, preventing electrification, and improving releasability. Typical examples of the organofluoro compound include hydrophobic fluoro compounds, including solid fluoro compound resins, such as ethylene tetrafluoride resins, or oily fluoro compounds, such as fluoro oils; or fluorine-containing surface-active agents described, for example, in JP-B-57-9053, column 8 to column 17, JP-A-61-20944, and JP-A-62-135826.

In the heat-development photographic material and the dye-fixing material, a matting agent can be used for the purpose of adhesion prevention, improvement of slipping property, matting, etc. Example matting agents include compounds, including silicon dioxide, polyolefins, polymethacrylates, and the like, as described in JP-A-61-88256, page (29), as well as compounds, including benzoguanamine resin beads, polycarbonate resin beads, ABS resin beads, and the like, described in JP-A-63-274944 and JP-A-63-274952. Other matting agents described in the above RD can be used. These matting agents are added into the uppermost layer (protective layer), and also into a lower layer if required.

Further, the constitutional layers of the heat-development photographic material and the dye-fixing material may contain a heat solvent, an antifoaming agent, a germ-proofing agent, a mildew-proofing agent, colloidal silica, etc. Specific examples of these additives are described, for example, in JP-A-61-88256, pages (26) to (32); JP-A-3-11338, and JP-B-2-51496.

In the present invention, an image-formation-accelerating agent can be used in the heat-development light-sensitive material and/or the dye-fixing material. Image-formation-accelerating agents function, for example, to accelerate the redox reaction between a silver salt oxidizing agent and a reducing agent, to accelerate a dye formation reaction from a dye-providing compound, a dye decomposition reaction, or a diffusion dye-releasing reaction, and to accelerate transfer of a dye from a layer of a heat-development light-sensitive material to a dye-fixing layer. These agents are classified, from the physicochemical functional point of view, for example, into bases or base precursors, nucleophilic compounds, high-boiling organic solvents (oils), heat solvents, surfactants, and compounds interactive with silver or silver ions. However, generally these compounds have a composite function, and they usually possess some of the above acceleration effects in combination. The details thereof are described in U.S. Pat. No. 4,678,739, columns 38 to 40.

As the base precursor, for example, salts of organic acids with bases that will be decarboxylated by heat, as well as compounds that will release amines by intramolecular nucleophilic substitution reaction, Lossen rearrangement, or Beckman rearrangement, are mentioned. Specific examples thereof are described, for example, in U.S. Pat. Nos. 4,514,493 and 4,657,848.

In the system wherein the heat development and the transfer of the dye are carried out simultaneously in the presence of a small amount of water, a base and/or a base precursor is preferably contained in the dye-fixing material, with a view to increasing the preservability of the heat-development light-sensitive material.

In addition to the above, combinations of hardly soluble metal compounds described in EP-A-210 660 and U.S. Pat. No. 4,740,445 with compounds capable of complex formation reaction with metal ions constituting these hardly soluble compounds (referred to as complex-forming compounds), and compounds capable of producing a base by electrolysis, as described in JP-A-61-232451, can also be used as the base precursor. Particularly the former means is effective. The hardly soluble compound and the complex-forming compound are advantageously added separately to the heat-development light-sensitive material and the dye-fixing element, as described in the above patent publications.

In the heat-development photographic material and/or the dye-fixing material for use in the present invention, in order to obtain a constant image all the time, against fluctuation of the processing temperature and the processing time at the time of development, various development-stopping agents can be used.

Herein, the term "a development-stopping agent" means a compound that neutralizes bases quickly or reacts quickly with bases after suitable development, to lower the base concentration in the film, to stop the development; or a compound that interacts with silver and silver salts, to inhibit the development. Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages (31) to (32).

As the base (support) of the heat-development light-sensitive material and the dye-fixing material in the present invention, those that can withstand the processing temperature are used. Generally, photographic bases, such as papers and synthetic polymers (films) described in "Shashin Kogaku no Kiso —Ginen Shashin-hen—," edited by Nihon Shashin-gakkai and published by Korona-sha, 1979, pages 223 to 240, can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose), those obtained by incorporating a pigment, such as titanium oxide, into films made of these, synthetic papers made from polypropylenes or the like by the film method, papers made by mixing synthetic resin pulps, for example, of polyethylenes, with natural pulp, Yankee paper, baryta paper, coated papers (particularly, cast-coated paper), metals, cloths, glasses, etc.

These may be used singly or may be used in the form of a base one or both of whose surfaces are laminated with a synthetic polymer, such as polyethylenes. This laminate layer can be previously formed to contain, if necessary, a dye or a pigment, such as titanium oxide, ultramarine, and carbon black.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

The backing surface of these bases may be coated with a hydrophilic binder plus a semiconductive metal oxide, such as tin oxide and alumina sol, carbon black, and another antistatic agent. Specifically, bases described, for example, in JP-A-63-220246 can be used.

Further, preferably the surface of the base is subjected to various surface treatments or it is provided with various undercoats, for the purpose of improving the adhesion to the hydrophilic binder.

The heat-development light-sensitive material and/or the dye-fixing material for use in the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is generally about 50 to 250° C. and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature, and it is particularly preferably from 50° C. or more, to a temperature about 10° C. lower than the heat development process.

The transfer of the dye can be brought about only by heat, but a solvent may be used to accelerate the dye transfer. Further, it is also useful to use a method described, for example, in U.S. Pat. No. 4,704,345, U.S. Pat. No. 4,740,445, and JP-A-61-238056, wherein the development and the transfer are carried out at the same time or successively by heating in the presence of a small amount of a solvent (particularly water). In this system, the heating temperature is preferably 50° C. or more to at the most the boiling point of the solvent, and for example, in the case wherein the solvent is water, the heating temperature is preferably 50° C. to 100° C.

Examples of the solvent that is used for acceleration of the development and/or for diffusion transfer of dyes include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complex-forming compound with a hardly-soluble metal salt, a mildew-proofing agent, and an antifungus agent may be contained in the solvent.

As the solvent to be used in these heat development and diffusion transfer steps, water is preferably used, and the water may be any water that is generally used. Specifically, for example, distilled water, tap water, well water, and mineral water can be used. In the heat-development apparatus in which the heat-development light-sensitive material for use in the present invention and the dye-fixing material are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-210555 may be used.

These solvents may be used in such a way that they are applied to the heat-development light-sensitive material or the dye-fixing material, or to both of them. The amount of the solvent to be used may be the weight of the solvent corresponding to or below the maximum swell volume of the entire coated film.

As the method of applying water, for example, methods described in JP-A-62-253159, page (5), and JP-A-63-85544 are preferably used. Further, the solvent may be enclosed in microcapsules or may take the form of a hydrate, to be previously built into either or both of the heat-development light-sensitive material and the dye-fixing material, for use.

The suitable temperature of the water to be applied is generally 30 to 60° C., as described, for example, in JP-A-63-85544, supra. It is particularly useful to make the temperature 45° C. or more, in view of prevention of propagation of bacteria in water.

To accelerate the dye transfer, a system can be adopted wherein a hydrophilic heat solvent that is solid at normal temperatures and melts at a higher temperature is built in the heat-development light-sensitive material and/or the dye-fixing material. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto.

Examples of the hydrophilic heat solvent include ureas, pyridines, amides, sulfonamides, imides, alcohols, oximes, and other heterocyclic compounds.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

As a method wherein the heat-development light-sensitive material and the dye-fixing material are placed one upon the other, methods described in JP-A-62-253159, and JP-A-61-147244, on page (27), can be applied.

According to the present invention, in a method for forming an image by exposing a light-sensitive material to light by using at least one exposure head with a plurality of exposure light sources, the occurrence of unevenness of exposure density can be improved remarkably.

Next, the present invention is described in more detail based on the following Examples, but the invention is not limited to those.

EXAMPLE

Example

Methods for Preparing Light-sensitive Silver Halide Emulsions

Light-Sensitive Silver Halide Emulsion (1) [for a red-sensitive emulsion layer]

To a well-stirred aqueous gelatin solution (prepared by adding 800 g of gelatin, 12 g of potassium bromide, 80 g of sodium chloride, and 1.2 g of Compound (a), to 26.3 liters of water, and keeping the temperature of the resulting solution at 53° C.), were added Solution (I) shown in Table 1 at a constant flow rate over 9 min, and Solution (II) at a constant flow rate over 9 min 10 sec starting before 10 sec of the addition of Solution (I). Further, after 36 min, Solution (III) shown in Table 1 was added at a constant flow rate over 24 min, and Solution (IV) was added at a constant flow rate over 25 min, in which the Solution (IV) was started to be added simultaneously with the Solution (III).

After washing with water and desalting in a usual manner, 880 g of lime-processed ossein gelatin and 2.8 g of Compound (b) were added, the pH was adjusted to 6.0, and after the chemical sensitization was carried out optimally at 60° C. for 71 min by adding 12.8 g of a ribonucleic acid decomposition product and 32 mg of trimethylthiourea, 2.6 g of 4-hydroxy-6-methyl-1,3,3a, 7-tetrazaindene, 3.2 g of Dye (a), 5.1 g of KBr, and 2,6 g of the later-described stabilizer were successively added, followed by cooling. In this way, 28.1 kg of a monodisperse cubic silver chlorobromide emulsion having an average grain size of 0.35 $\mu$m was obtained.

TABLE 1

| | Solution (I) | Solution (II) | Solution (III) | Solution (IV) |
|---|---|---|---|---|
| $AgNO_3$ | 1200 g | — | 2800 g | — |
| $NH_4NO_3$ | 2.5 g | — | 2.5 g | — |
| KBr | — | 546 g | — | 1766 g |
| NaCl | — | 144 g | — | 96 g |
| $K_2IrCl_6$ | — | 3.6 mg | — | — |
| | water to make 6.5 liters | water to make 6.5 liters | water to make 10 liters | water to make 10 liters |

Compound (a)

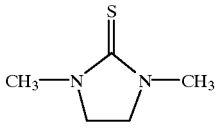

Compound (b)

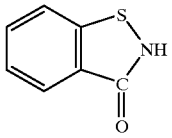

Dye (a1)

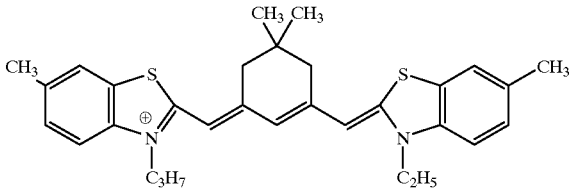

Compound (c)

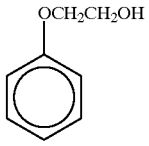

Dye (a2)

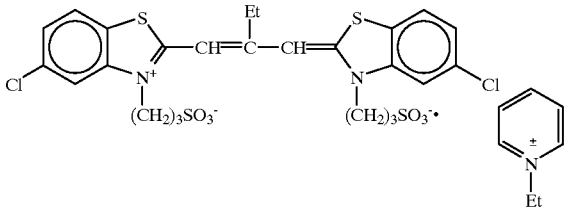

Dye (a3)

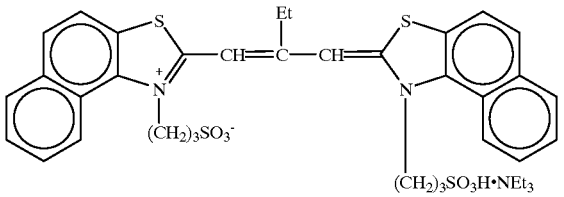

Light-Sensitive Silver Halide Emulsion (2) [for a green-sensitive emulsion layer]

To a well-stirred aqueous gelatin solution (prepared by adding 20 g of gelatin, 0.3 g of potassium bromide, 2 g of sodium chloride, and 30 mg of Compound (a), to 600 ml of water, and keeping the temperature of the resulting solution at 46° C.), were added Solutions (I) and (II) shown in Table 2, simultaneously at a constant flow rate over 9 min. After 5 min, Solutions (III) and (IV) shown in Table 2 were simultaneously added at a constant flow rate over 32 min. One minute after the completion of the addition of Solutions (III) and (IV), 60 ml of a methanol solution of dyes (containing 360 mg of Dye (b1) and 73.4 mg of Dye (b2)) was added at a time.

After washing with water and desalting (at a pH of 4.0 using Settling agent (a)) in a usual manner, 22 g of lime-processed ossein gelatin was added, suitable amounts of NaCl and NaOH were added to adjust the pH and pAg to 6.0 and 7.6 respectively, and the chemical sensitization was carried out optimally at 60° C. by adding 1.8 mg of sodium thiosulfate, and 180 mg of 4-hydroxy-6-methyl-1,3,3a,7-tetrazaindene, and after 90 mg of Antifogging agent (1) was added, the resultant mixture was cooled. Further, as antiseptic agents, 70 mg of Compound (b) and 3 ml of Compound (c) were added. In this way, 635 g of a monodisperse cubic silver chlorobromide emulsion having an average grain size of 0.30 $\mu$m was obtained.

TABLE 2

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | water to make 126 ml | water to make 131 ml | water to make 280 ml | water to make 289 ml |

Dye (b1)

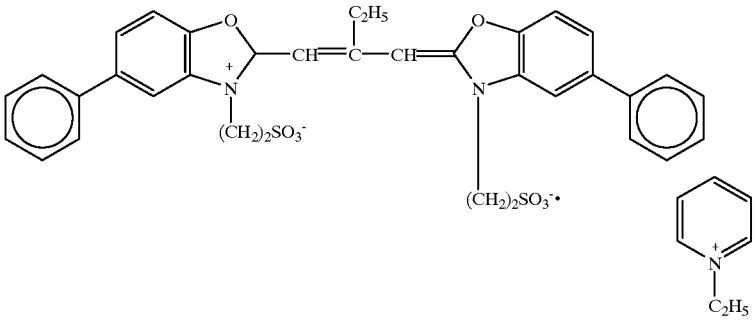

Dye (b2)

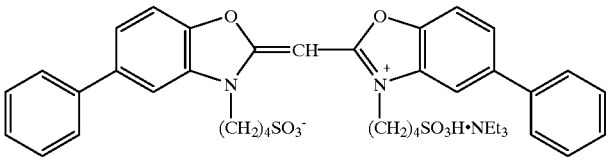

Dye (b3)

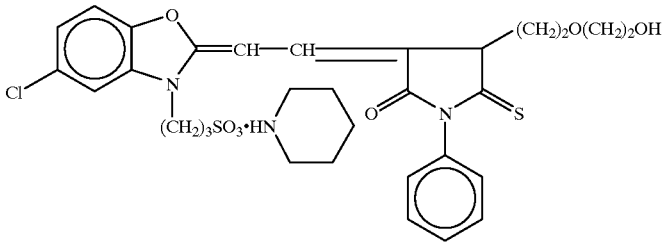

Dye (b4)

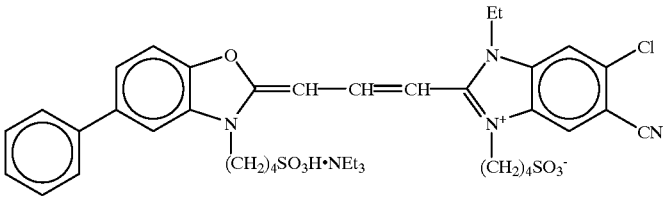

Settling agent (a)

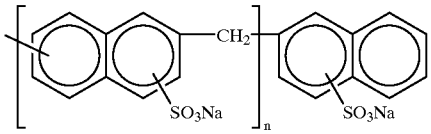

Antifoggant (1)

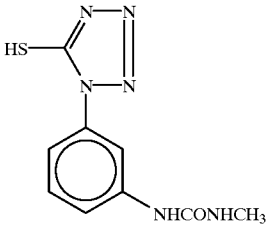

Light-Sensitive Silver Halide Emulsion (3) [for a blue-sensitive emulsion layer]

To a well-stirred aqueous gelatin solution (prepared by adding 1,582 g of gelatin, 127 g of KBr, and 660 mg of Compound (a), to 29.2 liters of water, and keeping the resultant solution at 72° C.), were added Solutions (I) and (II) having the compositions shown in Table 3, over 30 min, respectively, in which after 10 sec of the start of the addition of Solution (II), the Solution (I) was started to be added. Two minutes after the completion of the addition of Solution (I), Solution (V) was added; and after 5 min of the completion of the addition of Solution (II), Solution (IV) was started to be added, and after 10 sec thereof, Solution (III) was added, in which the Solution (III) was added over 27 min 50 sec and the Solution (IV) was added over 28 min.

Then, after washing with water and desalting (at a pH of 3.9 by using 32.4 g of Settling agent (b)) in a usual manner, 1,230 g of lime-processed ossein gelatin and 2.8 mg of Compound (b) were added, and the pH and the pAg were adjusted to 6.1 and 8.4, respectively. Then, after the chemical sensitization was carried out optimally at 65° C. for about 70 min by adding 24.9 mg of sodium thiosulfate, 13.1 g of Dye (c) and 118 ml of Compound (c) were added successively, followed by cooling. The silver halide grains of the resulting emulsion were potato-like grains and had a grain size of 0.53 μm, and the yield was 30.7 kg.

TABLE 3

| | Solution (I) | Solution (II) | Solution (III) | Solution (IV) | Solution (V) |
|---|---|---|---|---|---|
| $AgNO_3$ | 939 g | — | 3461 g | — | — |
| $NH_4NO_3$ | 3.4 g | — | 15.4 g | — | — |
| KBr | — | 572 g | — | 2464 g | — |
| KI | — | — | — | — | 22.0 g |
| | water to make 6.69 liters | water to make 6.68 liters | water to make 9.70 liters | water to make 9.74 liters | water to make 4.40 liters |

Settling agent (b)

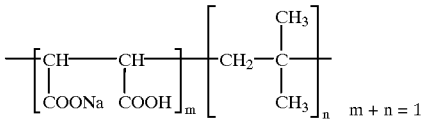

Dye (c1)

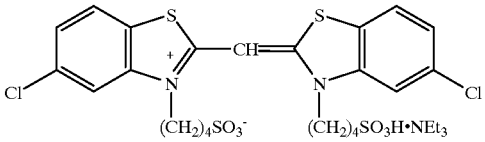

Dye (c2)

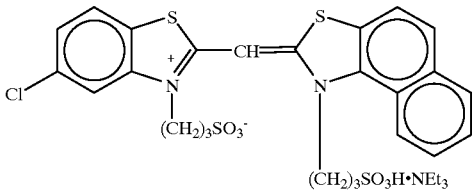

Dye (c3)

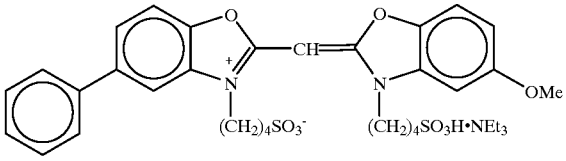

Next, a method for preparing a gelatin dispersion of Compound (d) is described.

0.2 g of Compound (d), 1.2 g of Compound (n), 1.2 g of High-Boiling Organic Solvent (1), 0.12 g of Compound (f), 0.25 g of Compound (g), 0.05 g of Compound (h), and 0.2 g of Surfactant (1) were weighed out, and 9.5 cc of ethyl acetate was added thereto, the resultant mixture was heated and dissolved at about 60° C., to make a uniform solution. After the resultant solution and 29.1 g of a 18% solution of lime-processed gelatin were stirred and mixed, dispersing was carried out with a homogenizer for 10 min at 10,000 rpm. After dispersing, 18.5 cc of water for dilution was added. The resultant dispersion was named Dispersion of Compound (d).

Compound (d)

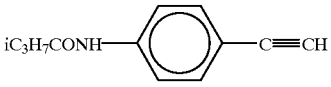

-continued

Compound (n)

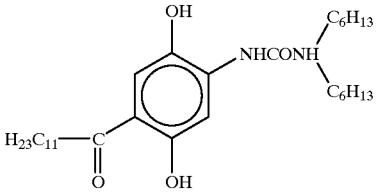

High-boiling organic solvent (1)

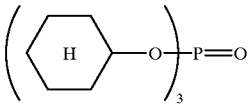

Compound (f)

$C_{26}H_{46.9}Cl_{7.1}$

Compound (g)

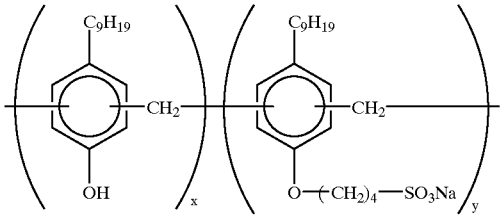

x/y = 58/42

Surfactant (1)

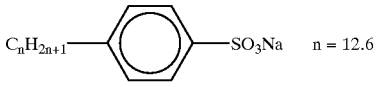

Compound (h)

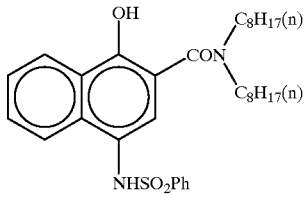

Next, the preparation method of a dispersion of zinc hydroxide is described.

12.5 g of zinc hydroxide with an average particle size of 0.2 μm, 1 g of carboxymethylcellulose as a dispersant, and 0.1 g of poly(sodium acrylate) were added to 100 ml of a 4% aqueous gelatin solution, and the grinding was carried out for 30 min in a mill using glass beads with an average particle diameter of 0.75 mm. Then the glass beads were separated, to obtain a dispersion of zinc hydroxide.

Next, methods for preparing a gelatin dispersion of a dye-providing compound are described.

7.3 g of Cyan Dye-Providing Compound (A1), 11.0 g of Cyan Dye-Providing Compound (A2), 0.8 g of Surfactant (1), 1 g of Compound (h), 2.2 g of Compound (i), 1.6 g of Compound (o), 7 g of High-Boiling Organic Solvent (1), and 3 g of High-Boiling Organic Solvent (2) were weighed out, and 26 ml of ethyl acetate and 1.2 ml of water were added thereto, and the resultant mixture was heated and dissolved at about 60° C., to make a uniform solution. After this solution, 65 g of a 16% solution of lime-processed gelatin, and 87 cc of water were stirred and mixed, dispersing was carried out with a homogenizer for 10 min at 10,000 rpm. After dispersing, 216 cc of water for dilution was added. The resultant dispersion was named Dispersion of cyan dye-providing compounds.

4.50 g of Magenta Dye-Providing Compound (B), 0.05 g of Compound (m), 0.05 g of Compound (h), 0.5 g of Compound (o), 0.094 g of Surfactant (1), and 2.25 g of High-Boiling Organic Solvent (2) were weighed out, and 10 ml of ethyl acetate was added thereto, and the resultant mixture was heated and dissolved at about 60° C., to make a uniform solution. After this solution, 15.2 g of a 16% solution of lime-processed gelatin, and 23.5 cc of water were stirred and mixed, dispersing was carried out with a homogenizer for 10 min at 10,000 rpm. Thereafter, 42 cc of water for dilution was added. The resultant dispersion was named Dispersion of a magenta dye-providing compound.

Cyan dye-providing compound (A1)

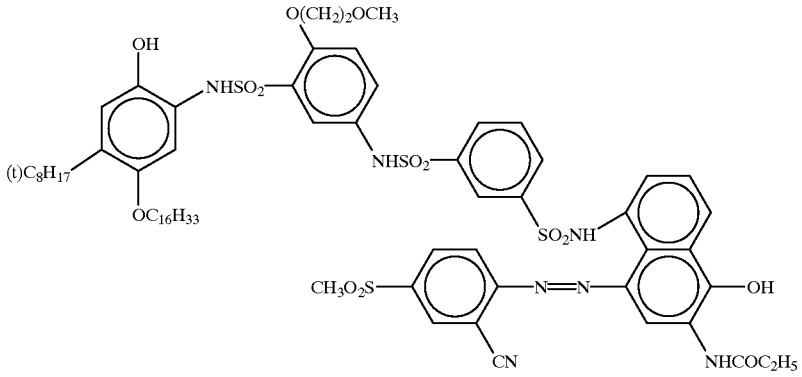

Cyan dye-providing compound (A2)

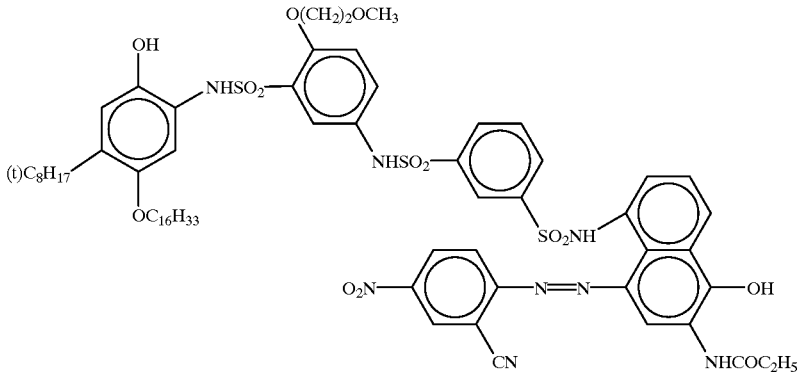

Compound (h)

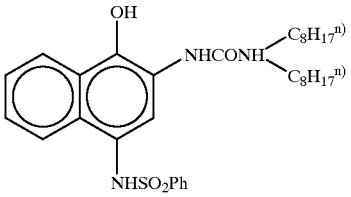

Compound (o)

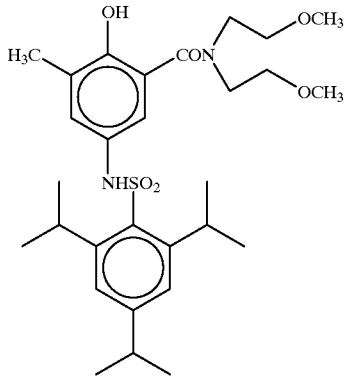

Compound (i)

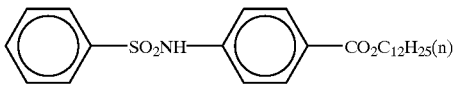

High-boiling solvent (2)

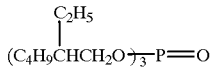

Magenta dye-providing compound (B)

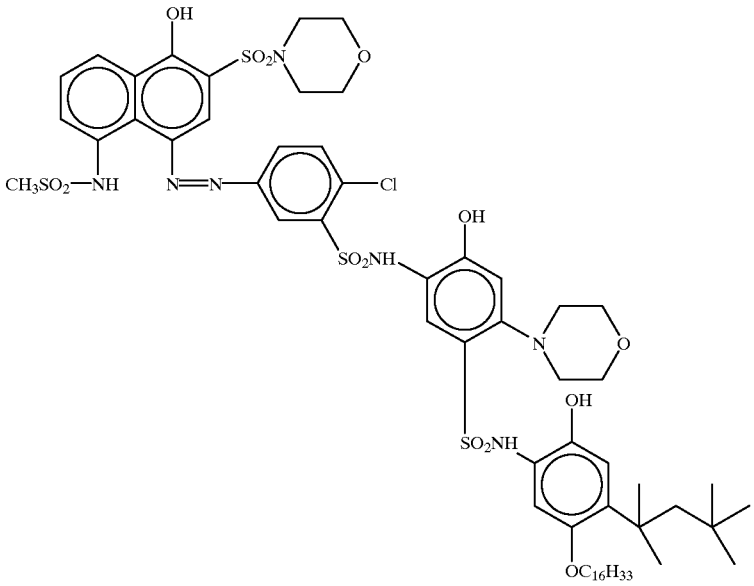

Compound (m)

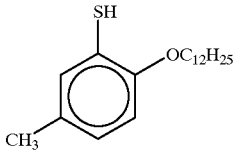

15 g of Yellow Dye-Providing Compound (C), 2.3 g of Compound (d), 0.9 g of Compound (h), 0.88 g of Surfactant (1), 3.9 g of Compound (j), 1.9 g of Compound (k), 1.5 g of Compound (o), and 16.9 g of High-Boiling organic Solvent (1) were weighed out, and 49 ml of ethyl acetate was added thereto, and the resultant mixture was heated and dissolved at about 60° C., to make a uniform solution. After this solution, 63.5 g of a 16% solution of lime-processed gelatin, and 103 cc of water were stirred and mixed, dispersing was carried out with a homogenizer for 10 min at 10,000 rpm. Thereafter, 94 cc of water for dilution was added. The resultant dispersion was named Dispersion of a yellow dye-providing compound.

Yellow dye-providing compound (C)

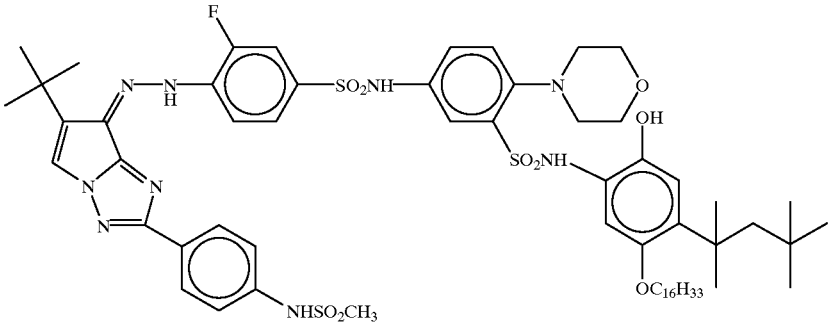

Compound (J)

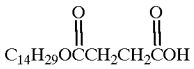

Compound (K)

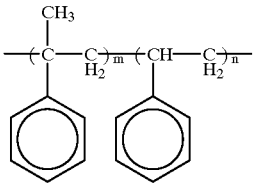

m:n = 9:1

A heat-develop light-sensitive material 101, as shown in Table 4, was constituted, using these materials.

TABLE 4

Constitution of light-sensitive material (Light-sensitive material 101)

| Layer No. | Layer Name | Additive | Coated amount ($g/m^2$) |
|---|---|---|---|
| Seventh layer | Protective layer | Acid-processed gelatin | 0.387 |
| | | PMMA Matting agent | 0.017 |
| | | Surfactant (2) | 0.006 |
| | | Surfactant (3) | 0.016 |
| Sixth layer | Inter-mediate layer | Gelatin | 0.763 |
| | | $Zn(OH)_2$ | 0.558 |
| | | Surfactant (3) | 0.002 |
| | | Compound (d) | 0.036 |
| | | Compound (f) | 0.011 |
| | | Compound (g) | 0.022 |
| | | Compound (h) | 0.005 |
| | | Compound (n) | 0.216 |
| | | High-boiling organic solvent (1) | 0.107 |
| | | $Ca(NO_3)_2$ | 0.012 |
| | | Surfactant (3) | 0.022 |
| | | Water-soluble polymer (1) | 0.003 |
| Fifth layer | Blue-sensitive layer | Silver halide emulsion (3) | in terms of silver 0.399 |
| | | Gelatin | 0.532 |
| | | Yellow dye-providing compound (15) | 0.348 |
| | | Compound (d) | 0.054 |
| | | Compound (h) | 0.021 |
| | | Compound (j) | 0.091 |
| | | Compound (k) | 0.045 |
| | | Compound (o) | 0.035 |
| | | High-boiling organic solvent (1) | 0.391 |
| | | Surfactant (1) | 0.021 |
| | | Water-soluble polymer (1) | 0.006 |
| Forth layer | Inter-mediate layer | Gelatin | 0.467 |
| | | $Zn(OH)_2$ | 0.341 |
| | | Surfactant (3) | 0.001 |
| | | Compound (d) | 0.022 |
| | | Compound (f) | 0.007 |
| | | Compound (g) | 0.014 |
| | | Compound (h) | 0.003 |
| | | Compound (n) | 0.132 |
| | | High-boiling organic solvent (1) | 0.066 |
| | | $Ca(NO_3)_2$ | 0.008 |
| | | Surfactant (1) | 0.014 |
| | | Water-soluble polymer (1) | 0.002 |
| Third layer | Green-sensitive layer | Silver halide emulsion (2) | in terms of silver 0.234 |
| | | Gelatin | 0.311 |
| | | Magenta dye-providing compound (B) | 0.357 |
| | | Compound (m) | 0.004 |
| | | Compound (h) | 0.004 |
| | | Compound (o) | 0.040 |
| | | High-boiling organic solvent (2) | 0.178 |
| | | Surfactant (1) | 0.010 |
| | | Water-soluble polymer (1) | 0.008 |

TABLE 4-continued

Constitution of light-sensitive material (Light-sensitive material 101)

| | | | |
|---|---|---|---|
| Second layer | Inter-mediate layer | Gelatin | 0.513 |
| | | Surfactant (4) | 0.069 |
| | | Surfactant (3) | 0.007 |
| | | Compound (d) | 0.022 |
| | | Compound (f) | 0.007 |
| | | Compound (g) | 0.014 |
| | | Compound (h) | 0.003 |
| | | Compound (n) | 0.132 |
| | | High-boiling organic solvent (1) | 0.066 |
| | | $Ca(NO_3)_2$ | 0.004 |
| | | Water-soluble polymer (1) | 0.020 |
| First layer | Red-sensitive layer | Silver halide emulsion (1) | in terms of silver 0.160 |
| | | Gelatin | 0.294 |
| | | Cyan dye-providing compound (A1) | 0.141 |
| | | Cyan dye-providing compound (A2) | 0.211 |
| | | Compound (i) | 0.041 |
| | | Compound (h) | 0.020 |
| | | Compound (o) | 0.031 |
| | | High-boiling organic solvent (1) | 0.060 |
| | | High-boiling organic solvent (2) | 0.138 |
| | | Surfactant (1) | 0.015 |
| | | Water-soluble polymer (1) | 0.017 |
| | | Stabilizer | 0.005 |
| | | Hardener | 0.035 |

Base (1) Polyethylene-laminated paper base (thickness 131 $\mu$m)

Base (1)

| Name of layer | Composition | Film thickness ($\mu$m) |
|---|---|---|
| Surface undercoat layer | Gelatin | 0.1 |
| Surface PE layer (Glossy) | Low-density polyethylene (Density 0.923): 89.2 parts<br>Surface-processed titanium oxide: 10.0 parts<br>Ultramarine: 0.8 parts | 36.0 |
| Pulp layer | Fine quality paper (LBKP/NBKP = 1/1, Density 1.080) | 64.0 |
| Back-surface PE layer (Matte) | High-density polyethylene (Density 0.960) | 31.0 |
| Back-surface undercoat layer | Gelating<br>Colloidal silica | 0.05<br>0.05 |
| | | 131.2 |

Surfactant (2)

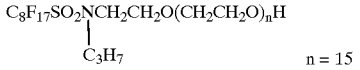

Surfactant (3)

Aerosol OT

Surfactant (4)

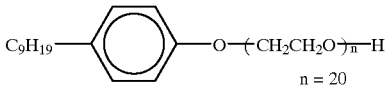

-continued

Water-soluble polymer (1)

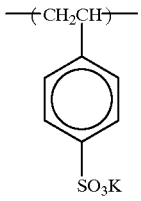

Hardener (1)

$CH{=}CHSO_2CH_2SO_2CH{=}CH_2$

Stabilizer

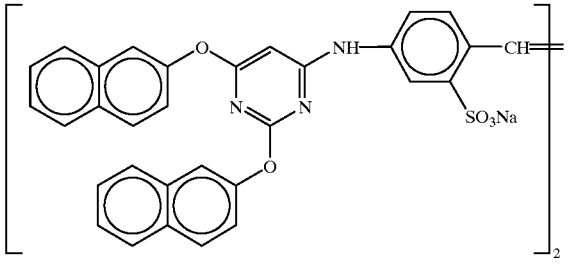

Next, a method for preparing an image-receiving material (dye-fixing material) is described.

Image-Receiving Material having a constitution as shown in Table 5, and Table 6, was prepared.

TABLE 5

Constitution of Image Receiving Material R201

| Number of layer | Additive | Coating amount ($mg/m^2$) |
|---|---|---|
| Sixth layer | Water-soluble polymer (5) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventing agent (1) | 7 |
| | Stain-preventing agent (2) | 12 |
| | Matting agent (1) | 7 |
| Fifth layer | Gelatin | 250 |
| | Water-soluble polymer (5) | 25 |
| | Anionic surfactant (3) | 9 |
| | Hardener (2) | 185 |
| Forth layer | Mordant (1) | 1850 |
| | Water-soluble polymer (2) | 260 |
| | Water-soluble polymer (4) | 1400 |
| | Dispersion of latex (1) | 600 |
| | Anionic surfactant (3) | 25 |
| | Nonionic surfactant (1) | 18 |
| | Guanidine picolinate | 2550 |
| | Sodium quinolinate | 350 |
| Third layer | Gelatin | 370 |
| | Mordant (1) | 300 |
| | Anionic surfactant (3) | 12 |
| Second layer | Gelatin | 700 |

TABLE 5-continued

Constitution of Image Receiving Material R201

| Number of layer | Additive | Coating amount ($mg/m^2$) |
|---|---|---|
| | Mordant (1) | 290 |
| | Water-soluble polymer (5) | 55 |
| | Water-soluble polymer (2) | 330 |
| | Anionic surfactant (3) | 30 |
| | Anionic surfactant (4) | 7 |
| | High-boiling organic solvent (3) | 700 |
| | Brightening agent (1) | 30 |
| | Stain-preventing agent (3) | 32 |
| | Guanidine picolinate | 360 |
| | Sodium quinolinate | 45 |
| First layer | Gelatin | 280 |
| | Water-soluble polymer (5) | 12 |
| | Anionic surfactant (1) | 14 |
| | Sodium metaborate | 35 |
| | Hardener (2) | 185 |
| Base (2) Polyethylene-Laminated Paper Base (thickness 215 $\mu$m) | | |

TABLE 6

Constitution of Base (2)

| Name of layer | Composition | Film thickness ($\mu$m) |
|---|---|---|
| Surface undercoat layer | Gelatin | 0.1 |
| Surface PE layer (Glossy) | Low-density polyethylene (Density 0.923): 90.2 parts<br>Surface-processed titanium oxide: 9.8 parts<br>Ultramarine: 0.001 parts | 36.0 |
| Pulp layer | Fine quality paper (LBKP/NBKP = 6/4, Density 1.053) | 152.0 |
| Back-surface PE layer (Matte) | High-density polyethylene (Density 0.955) | 27.0 |
| Back-surface undercoat layer | Styrene/acrylate copolymer<br>Colloidal silica<br>Polystyrene sodium sulfonate | 0.1 |
| | | 215.2 |

Anionic surfactant (1)

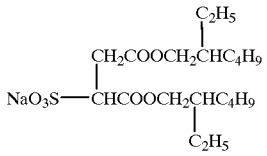

Anionic surfactant (2)

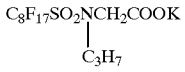

Anionic surfactant (3)

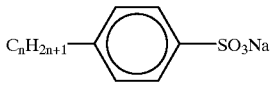

Anionic surfactant (4)

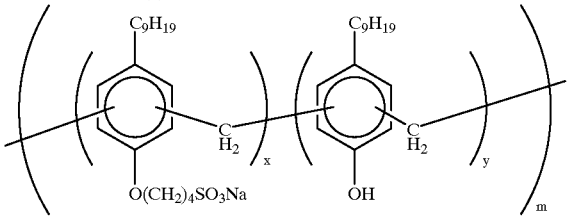

x:y = 4:6
m ≈ 6.8

Nonionic surfactant (1)

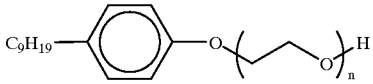

Amphoteric surfactant (1)

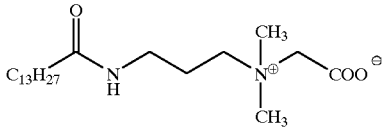

Brightening agent (1)

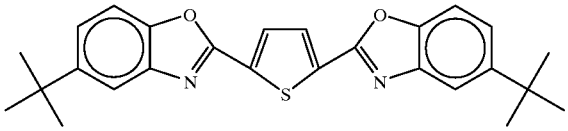

Mordant (1)

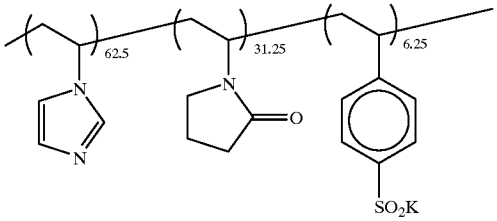

Stain-preventing agent (1)

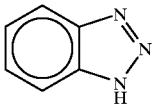

Stain-preventing agent (2)

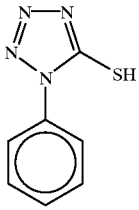

Stain-preventing agent (3)

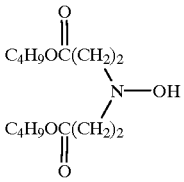

High-boiling organic solvent (3)

$C_{28}H_{46.9}Cl_{7.1}$

EMPARA 40
(trade name: manufactured by Ajinomoto K.K.)

Water-soluble polymer (5)

Sumikagel L5-H
(trade name: manufactured

-continued

| | |
|---|---|
| | by Sumitomo Kagaku CO.) |
| Water-soluble polymer (2) | Dextran (molecular weight 70,000) |
| Water-soluble polymer (3) | κ (kappa)-Carrageenan (trade name: manufactured by Taito Co.) |
| Water-soluble polymer (4) | MP polymer MP-102 (trade name: manufactured by Kurera CO.) |
| Dispersion of latex (1) | LX-438 (trade name: manufactured by Nippon Zeon Co.) |
| Matting agent (1) | SYLOID79 (trade name: manufactured by Fuji Davisson Chemical Co. |
| Hardener (2) | 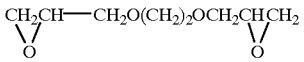 |

Preparation Method of Light-Sensitive Silver Halide Emulsion (4) for use in the present invention [for a red-sensitive emulsion layer]

28.1 kg of a monodisperse cubic silver chlorobromide emulsion having an average grain size of 0.29 μm was obtained in the same manner as Silver Halide Emulsion (1), except that simultaneously with the addition of Dye (a1), 1.0 g of Dye (a2) and 0.4 g of Dye (a3) were additionally added.

Preparation Method of Light-Sensitive Silver Halide Emulsion (5) for use in the present invention [for a green-sensitive emulsion layer]

635 g of a monodisperse cubic silver chlorobromide emulsion having an average grain size of 0.30 μm was obtained in the same manner as Silver Halide Emulsion (2), except that simultaneously with the addition of Dye (b1), 88 mg of Dye (b3) and 67 mg of Dye (b4) were additionally added.

Preparation Method of Light-Sensitive Silver Halide Emulsion (6) for use in the present invention [for a blue-sensitive emulsion layer]

30.7 kg of a monodisperse cubic silver chlorobromide emulsion having an average grain size of 0.53 μm was obtained in the same manner as Silver Halide Emulsion (3), except that simultaneously with the addition of Dye (c1), 5.3 g of Dye (c2) and 4.1 g of Dye (c3) were additionally added.

Light-Sensitive Material 102 was prepared in the same manner as Light-Sensitive Material 101, except that Light-Sensitive Silver Halide Emulsions (1), (2), and (3) were replaced with Silver Halide Emulsions (4), (5), and (6) for use in the present invention, respectively.

In the LED exposure apparatus, we used five blue LEDs, five green LEDs, and five red LEDs. The wavelengths in centers of gravity were each 455 nm, 458 nm, 462 nm, 465 nm, and 468 nm (specific wavelength region: 455 nm to 468 nm) for the blue LEDs; 534 nm, 538 nm, 541 nm, 546 nm, and 550 nm (specific wavelength region: 534 nm to 550 nm) for the green LEDs; and 650 nm, 654 nm, 658 nm, 662 nm, and 665 nm (specific wavelength region: 650 nm to 665 nm) for the red LEDs.

The exposure apparatus was a scanning exposure apparatus wherein the rates were 800 mm/sec in the main scanning direction and 2 mm/sec in the sub-scanning direction.

Then, the above Light-Sensitive Materials 101 to 102 were exposed to light and processed as follows.

Previously, by using the above LED exposure apparatus, only the 455-nm blue LED, the 534-nm green LED, and the 650-nm red LED were allowed to emit lights, to electrically set, so that the corresponding yellow density, magenta density, and cyan density each would be 0.7. Then, the remaining four LEDs of each color were electrically set, to emit the same amount of light as the above LEDs.

By using this LED scanning head, electrical signals were given to the previously set LEDs, to carry out the scanning exposure of the light-sensitive materials. Then, wetting water was supplied to the emulsion surface of the exposed light-sensitive material by a wire bar, and thereafter the film surface was brought in contact with Image Receiving Material R201. After heating at a heat development temperature of 83° C. for 20 sec, the image receiving material was peeled off from the light-sensitive material, and thus an image of 300DPI was obtained on the image receiving material.

It was examined whether or not there was unevenness of the density for the obtained gray image. Streaked unevenness due to the dispersion of the density at a pitch of about 85 mm was observed by visual inspection, in the image outputted from Light-Sensitive Material 101. On the other hand, density unevenness was observed little by visual inspection, in the image outputted from Light-Sensitive Material 102 according to the present invention.

Then, the dispersion of the density was measured by using a microdensitometer (measuring beam diameter: 10 μm). The image densities corresponding to respective LED wavelengths are shown in Table 7. It can be understood that Light-Sensitive Material 102 according to the present invention is remarkably improved in the change (fluctuation) in sensitivity to the change in wavelength of LED, in comparison to Light-Sensitive Material 101. The gamma of Light-Sensitive Materials 101 and 102 was each 2.

Further, as is shown in Table 7, the changes in sensitivity where the change in sensitivity to the change in wavelength was greatest, were 0.016 log E/nm, 0.018 log E/nm, and 0.016 log E/nm, for blue, green, and red, respectively, in Light-Sensitive Material 101; and these were 0.006 log E/nm, 0.007 log E/nm, and 0.006 log E/nm, for blue, green, and red, respectively, in Light-Sensitive Material 102 according to the present invention. The change in sensitivity can be found from the "gradient" of the tangent that is drawn to the spectral sensitivity curve at the point where the change in sensitivity has the largest value, to the wavelength (herein, log E is the value including a fogging density of 0.1 to 0.2). Thus, it can be understood that unevenness (streaked unevenness) of the density of an image can be improved unexpectedly and remarkably by bringing the change in sensitivity to the wavelength of LED to be 0.01 log E/nm or less.

TABLE 7

Changes in Density and Sensitivity to Wavelength (Center of Gravity) of LED

| | Light-sensitive material 101 | | Light-sensitive material 102 | |
|---|---|---|---|---|
| Wave-length | Density | Relative sensitivity | Density | Relative sensitivity |
| 455 nm | 0.70 (Yellow) | 0 | 0.70 (Yellow) | 0 |
| 458 nm | 0.72 (Yellow) | 0.01 | 0.73 (Yellow) | 0.015 |
| 462 nm | 0.68 (Yellow) | −0.01 | 0.74 (Yellow) | 0.020 |
| 465 nm | 0.62 (Yellow) | −0.04 | 0.73 (Yellow) | 0.015 |
| 468 nm | 0.54 (Yellow) | −0.08 | 0.70 (Yellow) | 0 |
| 534 nm | 0.70 (Magenta) | 0 | 0.70 (Magenta) | 0 |
| 538 nm | 0.80 (Magenta) | 0.05 | 0.74 (Magenta) | 0.02 |
| 541 nm | 0.83 (Magenta) | 0.065 | 0.77 (Magenta) | 0.030 |
| 546 nm | 0.82 (Magenta) | 0.06 | 0.75 (Magenta) | 0.025 |
| 550 nm | 0.80 (Magenta) | 0.05 | 0.72 (Magenta) | 0.01 |
| 650 nm | 0.70 (Cyan) | 0 | 0.70 (Cyan) | 0 |
| 654 nm | 0.71 (Cyan) | 0.005 | 0.73 (Cyan) | 0.015 |
| 658 nm | 0.68 (Cyan) | −0.01 | 0.74 (Cyan) | 0.02 |
| 662 nm | 0.60 (Cyan) | −0.045 | 0.73 (Cyan) | 0.015 |
| 665 nm | 0.54 (Cyan) | −0.08 | 0.70 (Cyan) | 0 |

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming an image on a light-sensitive material having on a base at least a light-sensitive silver halide emulsion and a binder, which comprises, subjecting at least one light-sensitive layer to exposure to light with an exposure head that has a plurality of different light sources for emitting lights in respective specific wavelength regions correspondingly to adjacent exposure picture elements, to form an image, wherein, in the specific wavelength regions from the shortest wavelength to the longest wavelength for the respective plurality of light sources to be used, the change in sensitivity of the light-sensitive material in a spectral sensitivity curve obtained by plotting sensitivities of the light-sensitive material in terms of the specific wavelength regions including the wavelengths in centers of gravity of respective light sources is 0.01 log E/nm or less, wherein the light sources for emitting lights in specific wavelength regions are LEDs having wavelengths selected from the light emitting wavelength range of the visible region and the infrared region.

2. The method for forming an image as claimed in claim 1, wherein the light-sensitive material is a heat-development light-sensitive material having on a base at least three silver halide emulsions different in color sensitivity, a binder, and a dye-providing compound.

3. The method for forming an image as claimed in claim 1, wherein the exposure light sources for emitting lights in specific wavelength regions are blue LEDs, green LEDs, and/or red LEDs.

4. The method for forming an image as claimed in. claim 1, wherein the specific wavelength region is the range within ±10 nm selected from among 430 to 480 nm in the case of a blue LED.

5. The method for forming an image as claimed in claim 1, wherein the specific wavelength region is the range within ±10 nm selected from among 500 to 560 nm in the case of a green LED.

6. The method for forming an image as claimed in claim 1, wherein the specific wavelength region is the range within ±10 nm selected from among 640 to 690 nm in the case of a red LED.

7. The method for forming an image as claimed in claim 1, wherein the plurality of light sources has 2 to 400 light sources for each light emitting color.

8. The method for forming an image as claimed in claim 1, wherein the light-sensitive silver halide emulsion in the light-sensitive material is subjected to spectral sensitization with 2 or more but less than 5 sensitizing dyes.

* * * * *